US010626526B2

(12) United States Patent
Dua et al.

(10) Patent No.: US 10,626,526 B2
(45) Date of Patent: Apr. 21, 2020

(54) INTERMITTENT WEAVING SPLICER

(71) Applicant: NIKE, Inc., Beaverton, OR (US)

(72) Inventors: Bhupesh Dua, Portland, OR (US); Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 517 days.

(21) Appl. No.: 15/383,764

(22) Filed: Dec. 19, 2016

(65) Prior Publication Data

US 2017/0101732 A1 Apr. 13, 2017

Related U.S. Application Data

(62) Division of application No. 13/748,746, filed on Jan. 24, 2013, now Pat. No. 9,533,855.

(Continued)

(51) Int. Cl.

*D03D 49/12* (2006.01)
*D03D 51/00* (2006.01)

(Continued)

(52) U.S. Cl.

CPC ..... *D03D 49/12* (2013.01); *B65H 69/06* (2013.01); *D03D 13/00* (2013.01); *D03D 15/00* (2013.01); *D03D 47/34* (2013.01); *D03D 47/38* (2013.01); *D03D 49/04* (2013.01); *D03D 51/00* (2013.01); *D03J 1/04* (2013.01); *D03J 1/16* (2013.01); *B65H 2701/31* (2013.01)

(58) Field of Classification Search

CPC ..... D03D 49/12; D03D 49/14; D03D 51/00; D03D 15/00; D03D 47/38; D03D 47/34; D03D 13/00; D03D 49/04; D03D 45/02; D03J 1/16; D03J 1/18; D03J 1/04; D02H 13/22; D02H 13/24; D02H 13/14; D02H 13/12; B65H 69/06; B65H 69/061; B65H 2701/31; B65H 69/063; B65H 69/065; D01H 15/00

USPC ..... 28/209, 210, 211

See application file for complete search history.

(56) References Cited

U.S. PATENT DOCUMENTS 1,227,716 A 5/1917 Wenzel
2,294,368 A 9/1942 Harter (Continued)

FOREIGN PATENT DOCUMENTS

BE 1003689 A3 5/1992
CN 1087146 A 5/1994

(Continued)

OTHER PUBLICATIONS

English language machine translation of BE 1003689 (doc. pub. date May 1992); 12 pages.*

(Continued)

*Primary Examiner* — Amy Vanatta

(74) *Attorney, Agent, or Firm* — Shook Hardy & Bacon, LLP

(57) ABSTRACT

Woven products using combined materials are provided. An intermittent weaving splicer terminates and combines materials having different functional and/or aesthetic properties to create woven products that reflect the different properties of the combined material. Further, a dynamic tensioner variably adjusts tension on the combined materials based on the different properties of the combined material.

20 Claims, 5 Drawing Sheets

Related U.S. Application Data

(60) Provisional application No. 61/590,177, filed on Jan. 24, 2012.

(51) Int. Cl.

| | |
|---|---|
| ***D03J 1/16*** | (2006.01) |
| ***B65H 69/06*** | (2006.01) |
| ***D03D 49/04*** | (2006.01) |
| ***D03D 15/00*** | (2006.01) |
| ***D03D 13/00*** | (2006.01) |
| ***D03D 47/34*** | (2006.01) |
| ***D03D 47/38*** | (2006.01) |
| ***D03J 1/04*** | (2006.01) |

(56) References Cited

U.S. PATENT DOCUMENTS 2,362,801 A 11/1944 Clement
2,673,577 A 3/1954 Mills
2,835,277 A 5/1958 Groat
3,143,149 A 8/1964 Stoudenmire
3,161,941 A 12/1964 Heinz
3,313,323 A 4/1967 Calemard
3,486,957 A 12/1969 Fish et al.
3,610,292 A 10/1971 Wasyleviez
3,621,885 A 11/1971 Egloff et al.
3,626,991 A 12/1971 Backenecker
3,751,981 A 8/1973 Jernigan et al.
3,779,289 A 12/1973 Bulcock et al.
3,796,032 A 3/1974 Clontz
3,814,140 A 6/1974 Serturini
3,879,824 A 4/1975 Mizuno
3,916,956 A 11/1975 Harris et al.
4,031,925 A 6/1977 Santucci
4,046,172 A 9/1977 Russell
4,077,438 A 3/1978 Tanaka et al.
4,352,380 A 10/1982 Owen et al.
4,448,223 A 5/1984 Deborde et al.
4,453,994 A 6/1984 Van Dort
4,520,849 A 6/1985 Suzuki et al.
4,526,211 A 7/1985 Suso
4,546,802 A 10/1985 Best
4,589,361 A 5/1986 Starnes et al.
4,600,039 A 7/1986 Corain
4,607,482 A 8/1986 Otoshima et al.
4,688,606 A 8/1987 Tamatani
4,693,771 A 9/1987 Payet et al.
4,738,093 A 4/1988 Zumfeld et al.
4,756,343 A 7/1988 Angebault et al.
4,781,221 A 11/1988 Onishi et al.
4,805,276 A 2/1989 Plaschy
4,815,498 A 3/1989 Gryson et al.
4,834,145 A 5/1989 Lewyllie et al.
4,834,147 A 5/1989 Eberle et al.
4,844,131 A 7/1989 Anderson et al.
4,909,283 A 3/1990 Verclyte
4,917,153 A 4/1990 Mori et al.
4,957,144 A 9/1990 Watanabe et al.
4,964,442 A 10/1990 Tacq et al.
5,050,647 A 9/1991 Baeck et al.
5,070,912 A 12/1991 Ludwig
5,075,151 A 12/1991 Kufner et al.
5,079,908 A 1/1992 Stahlecker et al.
5,090,456 A 2/1992 Kasahara et al.
5,105,855 A 4/1992 Stacher
5,105,856 A 4/1992 Wahhoud
5,155,987 A 10/1992 Vogel et al.
5,158,119 A 10/1992 Pezzoli
5,323,324 A 6/1994 Fredriksson
5,332,007 A 7/1994 Wahhoud et al.
5,335,699 A 8/1994 Beyaert et al.
5,375,627 A 12/1994 Iida et al.
5,462,094 A * 10/1995 Josefsson ..... B65H 59/26 139/194
5,568,827 A 10/1996 Debaes et al.
5,575,314 A 11/1996 Capitanio et al.
5,588,470 A 12/1996 Shiraki et al.
5,649,570 A 7/1997 Wahhoud et al.
5,669,424 A 9/1997 Schiller et al.
5,680,751 A 10/1997 Premi et al.
5,735,316 A 4/1998 Hehle
5,862,660 A 1/1999 Haasen et al.
5,996,647 A 12/1999 Krumm
6,016,850 A * 1/2000 Zimmermann ..... D03D 49/12 139/97
6,026,865 A 2/2000 Krumm et al.
6,039,086 A 3/2000 Dornier et al.
6,050,302 A 4/2000 Guse et al.
6,058,980 A 5/2000 Scari et al.
6,155,306 A 12/2000 Katsukura et al.
6,199,360 B1 3/2001 Premi et al.
6,223,779 B1 5/2001 Speich
6,260,586 B1 7/2001 Fratus
6,311,737 B2 11/2001 Wahhoud et al.
6,321,796 B1 11/2001 Sawada
6,339,921 B1 1/2002 Lassmann et al.
6,418,974 B1 7/2002 King
6,470,917 B1 10/2002 Yamamoto
6,575,201 B2 6/2003 Buesgen
6,868,660 B2 3/2005 Premi
6,892,766 B2 5/2005 Bryn et al.
7,117,900 B2 10/2006 Lam et al.
7,992,596 B2 8/2011 Khokar et al.
8,091,589 B2 1/2012 Yokokawa
8,182,550 B1 5/2012 Hayes
8,192,824 B2 6/2012 Rock et al.
2001/0013377 A1 8/2001 Wahhoud et al.
2001/0037545 A1* 11/2001 Stuttem ..... B65H 49/12 28/248
2002/0009590 A1 1/2002 Matsui et al.
2002/0020457 A1 2/2002 Yamamoto
2002/0195160 A1* 12/2002 Siegl ..... D03D 49/10 139/105
2003/0051295 A1 3/2003 Soane et al.
2003/0167747 A1 9/2003 Schatton
2003/0187140 A1 10/2003 Lintecum et al.
2004/0011912 A1 1/2004 t'Sas
2004/0016093 A1 1/2004 Lueneburger et al.
2004/0020548 A1 2/2004 Yamamoto
2004/0021255 A1 2/2004 Bilanin et al.
2004/0154679 A1 8/2004 Yamamoto
2004/0182465 A1 9/2004 Ward
2005/0066866 A1 3/2005 Pederzini
2005/0166989 A1 8/2005 Debaes
2005/0208857 A1 9/2005 Baron et al.
2005/0208860 A1 9/2005 Baron et al.
2006/0144458 A1 7/2006 Wahhoud et al.
2007/0087162 A1 4/2007 Mandawewala
2007/0243783 A1 10/2007 Kotani et al.
2008/0085648 A1 4/2008 Hirosue et al.
2009/0007981 A1 1/2009 Khokar
2009/0056900 A1 3/2009 O'Connor et al.
2010/0077634 A1 4/2010 Bell
2010/0206507 A1 8/2010 Quigley
2010/0307629 A1 12/2010 Citterio
2011/0052861 A1 3/2011 Rock
2011/0132488 A1 6/2011 Teng et al.
2013/0190917 A1* 7/2013 Cross ..... D06B 1/00 700/140

FOREIGN PATENT DOCUMENTS

DE 3438265 A1 * 6/1985
DE 3629735 A1 3/1988
DE 3915085 A1 11/1990
DE 19705986 A1 8/1998
DE 10040652 A1 2/2002
EP 0144119 A2 6/1985
EP 0292044 A1 11/1988
EP 0534429 A1 3/1993
EP 0643161 A1 3/1995
EP 1593765 A1 11/2005

(56) References Cited

FOREIGN PATENT DOCUMENTS

| | | | |
|---|---|---|---|
| EP | 2175057 | A1 | 4/2010 |
| EP | 2330238 | A2 | 6/2011 |
| GB | 190917435 | A | 5/1910 |
| GB | 733042 | A | 7/1955 |
| GB | 2187766 | A | 9/1987 |
| JP | S6088145 | A | 5/1985 |
| JP | S64-006142 | A | 1/1989 |
| JP | H11246454 | A | 9/1999 |
| JP | 2003073954 | A | 3/2003 |
| JP | 2003147664 | A | 5/2003 |
| JP | 2004149968 | A | 5/2004 |
| JP | 2009155742 | A | 7/2009 |
| KR | 19950000951 | A | 1/1995 |
| WO | 0047805 | A1 | 8/2000 |
| WO | 0228760 | A1 | 4/2002 |
| WO | 02079554 | A2 | 10/2002 |
| WO | 03029542 | A1 | 4/2003 |
| WO | 2008113692 | A2 | 9/2008 |
| WO | 2009106785 | A1 | 9/2009 |

OTHER PUBLICATIONS

Naskar et al. "Studies on Tyre Chords: Degradation of Polyester Due to Fatigue" Polymer Degradation and Stability. vol. 83, Issue 1, pp. 179-180. Especially Table 2, p. 178 (Jan. 2004).

Decision to grant a European patent pursuant to Article 97(1) EPC dated Nov. 2, 2018 in European Patent Application No. 13740573.4, 2 pages.

Communication pursuant to Article 94(3) EPC dated Dec. 21, 2018 in European Patent Application No. 13740548.6, 6 pages.

Communication pursuant to Article 94(3) dated Jan. 4, 2019 in European Patent Application No. 13741097.3, 6 pages.

Communication pursuant to Article 94)3) dated Jul. 29, 2019 in European Patent Application No. 13740548.6, 6 pages.

Communication under Rule 71(3) dated Aug. 7, 2019 in European Patent Application No. 13741097.3, 49 pages.

* cited by examiner

INTERMITTENT WEAVING SPLICER

CROSS-REFERENCE TO RELATED APPLICATIONS

This application is a divisional application of copending U.S. application Ser. No. 13/748,746, filed Jan. 24, 2013, which claims the benefit of U.S. Provisional Application No. 61/590,177, filed Jan. 24, 2012, both of which are entitled "Intermittent Weaving Splicer." The entirety of the aforementioned applications is hereby incorporated by reference herein.

TECHNICAL FIELD

The present invention relates to a weaving system in general. More specifically, the present invention relates to an intermittent weaving splicer. The intermittent weaving splicer is contemplated to dynamically terminate and combine different materials, which are subsequently used to weave different types of textiles, apparel, accessories, and shoes. As well, the present invention relates to a dynamic tensioner that applies varying levels of tension to weaving materials based, at least in part, on properties of the material and/or a desired resulting woven product.

BACKGROUND

Traditionally, splicing devices have been used to join a yarn end of a first spool of yarn that has been consumed with an initial yarn end of a second spool of yarn. The splicing of the two yarn ends may be accomplished by mingling the fibers that compose the two yarns. This is typically a passive process that is initiated only upon recognition of a yarn end. As well, traditional weaving tensioning devices apply a constant level of tension to a weaving material as it is being woven.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, the present invention is directed toward an intermittent weaving splicer that dynamically terminates a material (e.g., yarn, thread, fiber) and combines different materials to create a combined material having different functional or aesthetic properties along the length of the combined material. The combined material may subsequently be used in the weaving of a variety of structures including fabrics, textiles, composite base materials, apparel, shoes, and accessories. For example, aspects of the following may be implemented in the manufacture of two-dimensional and/or three-dimensional articles. The varying properties of the combined material may, in turn, impart different properties to the woven product at one or more locations.

The present invention is also directed to a dynamic tensioner that applies variable amounts of tension to the combined material while it is being woven. The amount of tension applied depends on the characteristics or properties of the combined material and/or a desired resulting product. The dynamic tensioner may be used in combination with the intermittent splicer to assist in the accurate placement of the combined material in the woven product.

Accordingly, in one aspect, the present invention is directed towards an intermittent weaving splicer comprising a first material input, a second material input, a first material terminator, a combining unit, and a combined material output.

In a second aspect, the present invention is directed to a weaving system comprising a loom, an intermittent weaving splicing device that terminates and combines material inputs to produce a combined material output, and a logic unit that interacts with the loom and the splicing device.

In yet another aspect, the present invention is directed to a method of using an intermittent weaving splicer comprising receiving a first material, receiving a second material, terminating the first material, joining the first material and the second material to produce a combined material, and outputting the combined material.

BRIEF DESCRIPTION OF THE DRAWINGS

Examples are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, the present invention is directed toward an intermittent weaving splicer that dynamically terminates a material (e.g., yarn, thread, fiber) and combines different materials to create a combined material having different functional or aesthetic properties along the length of the combined material. The combined material may subsequently be used in the weaving of a variety of structures including fabrics, textiles, composite base materials, apparel, shoes, and accessories. For example, aspects of the following may be implemented in the manufacture of two-dimensional and/or three-dimensional articles. The varying properties of the combined material may, in turn, impart different properties to the woven product at one or more locations.

The present invention is also directed to a dynamic tensioner that applies variable amounts of tension to the combined material while it is being woven. The amount of tension applied depends on the characteristics or properties of the combined material and/or a desired resulting product. The dynamic tensioner may be used in combination with the intermittent splicer to assist in the accurate placement of the combined material in the woven product.

Figure 1:
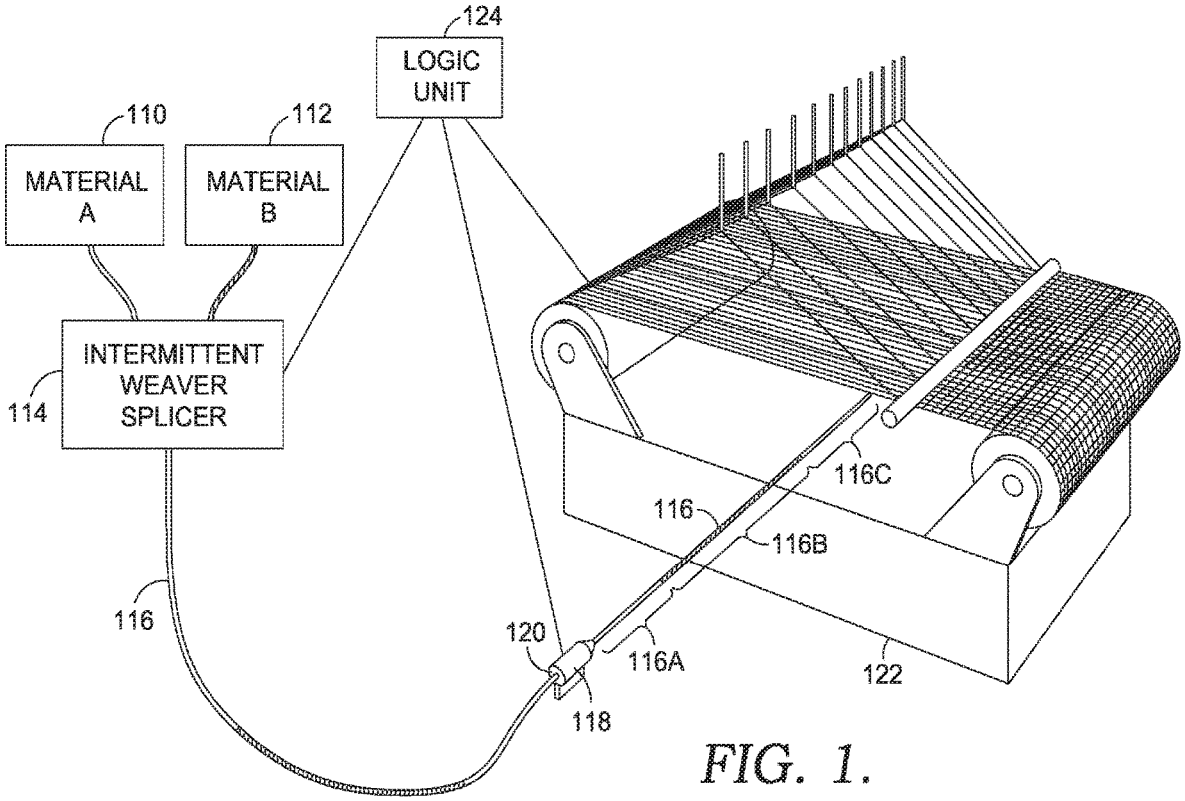
FIG. 1 depicts an exemplary intermittent weaving splicer within an exemplary weaving system in an aspect of the present invention.

FIG. 1 illustrates a system 100 that comprises an intermittent weaving splicer 114, a dynamic tensioner 120, a feeding component 118, a loom 122, and a logic unit 124. However, it is contemplated that additional components may be implemented in conjunction (or independently) with those depicted herein in exemplary aspects. Further, it is contemplated that any number of those components depicted, discussed, or implied in connection with FIG. 1 may also be implemented in exemplary aspects.

The intermittent splicer 114 may receive two or more materials such as material A 110 and material B 112 through one or more input ports. As used herein, a material received by the intermittent splicer 114 may include, for example, yarn, thread, webbing, strands, braids, and the like. Further, it is contemplated that the material may be formed, at least in part, with organic substances (e.g., cotton, rubber), polymer-based substances (e.g., nylon, polyester, synthetic rubber), metallic-based substances (e.g., copper, silver, gold, aluminum), and other engineered materials (e.g., aramid synthetic fibers, carbon-fiber, fiber glass). The material is also contemplated having varied physical characteristics (as will be discussed hereinafter). For example, the material may have varied diameter, elasticity, abrasion resistance, chemical reactivity traits, tension modulus, tensile strength, moisture absorbance, and the like.

The material A 110 and the material B 112 may comprise different types of materials. For instance, the materials 110 and 112 may differ in diameter, density, color, functional properties, aesthetic properties, mode of manufacture (extrusion, spun, molded, etc.), treatments applied to the materials 110 and 112, and so on. Functional properties may comprise elasticity, stiffness, water solubility, thermoreactivity, chemical reactivity, and the like. Treatments applied to the materials 110 and 112 may comprise water proofing, wax coating, and/or applying coatings that impart a matte, luster, reflective, or shiny finish to the materials 110 and 112. Treatments may also comprise reactive coatings that may react with water, heat, chemicals, and the like. Additionally, it is contemplated that a multi-substance material is used. A multi-substance material may be a material having an outer sheath of a different substance than an interior core. In this example, the outer sheath may impart certain characteristics to the multi-substance material that differ from the internal core. For example, the internal core may have a high elasticity and the outer core may be a reactive coating that prevents the stretch of the multi-substance material. Therefore, as will be discussed hereinafter, it is contemplated that portions of the outer core may be selectively removed (e.g., reactively removed by chemical means or light, for example) to allow the properties of the inner core to be exhibited in those portions where the outer core has been removed. Alternative arrangements of a multi-substance material are contemplated (e.g., reactive core, reactive fibers intertwined with non-reactive fibers).

Returning to FIG. 1, in an exemplary aspect, the intermittent splicer 114 may receive material A 110 through a first input port (not shown) and material B 112 through a second input port (not shown). Alternatively, material A 110 and material B 112 may be received through a single input port. Although only two materials are depicted in FIG. 1, it is contemplated that the intermittent splicer 114 may receive any number of materials. In an exemplary aspect, it is contemplated that the material is maintained by a spool-like structure for feeding into the intermittent splicer 114 for effective receipt.

The intermittent splicer 114 receives material A 110 and material B 112. After being received by the intermittent splicer 114, the materials may be fed through a measuring component (not shown) that measures predetermined distances of the materials 110 and 112. The measuring component may comprise a toggle wheel, a timing system that measures the rate and/or time at a known rate at which the materials 110 and 112 are being received, a caliper system, and/or a vision or optical system to measure the predetermined distances/lengths of a material. After predetermined distances have been measured for material A 110 and/or material B 112, the intermittent splicer 114 may be programmed to terminate material A 110 and/or material B 112 at predefined distances.

The intermittent splicer 114 may use mechanical means such as a knife to terminate (e.g., cut) the materials 110 and/or 112. As well (or in the alternative), the intermittent splicer 114 may use a laser, air, ultrasound, water, heat, chemicals, and the like to terminate the materials 110 and/or 112 at defined lengths. Therefore, it is contemplated that the intermittent splicer 114 is functional to terminate a continuous run of material at an intermediate point in the run. For example, a material may be maintained on a spool that has several hundred feet of continuous material prepared to be fed through the intermittent splicer 114. In this example, the intermittent splicer 114 may terminate the material at any point along the length of the several hundred feet of continuous material (any number of times). As a result, any desired length of material may be used at any portion of a resulting combined material resulting from the intermittent splitter 114.

The intermittent splicer 114 may be mechanically operated by one or more mechanisms controlled by the logic unit 124. For example, it is contemplated that the intermittent splicer 114 may, without intervention from a human operator, terminate a material using an electro-mechanical mechanism (e.g., an actuator, pneumatic, hydraulic, motor) and/or the like. By controlling the terminating portion of the intermittent splicer 114 by the logic unit 124, an automated system may be implemented that once started, may not require intervention by a human to manufacture an article having a variety of materials strategically located in a common weft pass (or warp).

Once terminated, the materials 110 and 112 may be joined together by the intermittent splicer 114 to create a combined material 116. Traditional methods of joining materials 110 and 112 together such as fraying the ends of materials 110 and 112 and joining the frayed ends may be employed. For example, the materials to be joined may be comprised of a plurality of fibers that when separated (e.g., frayed) at each respective end may then be intermeshed together to form an effective bond between a first end of a first material and a first end of a second material. Additionally, other methods to join the materials 110 and 112 may be used such as ultrasonic fusing, lasering, welding, adhesive, heat, wrapping, tying, folding, and/or twisting. Further, it is contemplated that a combined process may be implemented to terminate and fuse. For example, a melting process may both terminate a first thread and fuse the newly created end to a second thread.

It is contemplated that the intermittent splicer 114 may terminate a first material at a location along the length of the first material to form a first end and a second end relative to the location of termination. The first end, in this example, is proximate an output region of the intermittent splicer 114 and the second end is proximate an input region of the intermittent splicer 114. The first end, in this example, may be joined with a previous second end of a second material (e.g., also proximate the input portion of the intermittent splicer 114). Further, the second end of the first material may then be joined with a newly created first end (e.g., proximate the output portion of the intermittent splicer 114) of the second material. As will be discussed hereinafter, it is contemplated that any number of materials in any sequence may be joined.

The intermittent splicer 114 may also be comprised of one or more maintainers. A maintainer may maintain one or more portions of the materials 110 and/or 112 in a desired position during a terminating process and/or during a joining process. For example, it is contemplated that a compression mechanism may hold the first material while terminating the first material. Further, it is contemplated that a maintainer may hold the combined material (e.g., first end of the first material) while being fused with a second end of the second material, even momentarily. However, it is also contemplated that the terminating and/or joining processes may be done on the fly (e.g., as the materials continue to pass through the intermittent splicer 114).

The intermittent splicer 114 may also comprise an expelling component (not shown) at the output portion. Once materials 110 and 112 have been combined to generate a combined material 116, the expelling component expels the combined material 116 from the intermittent splicer 114. The expelling component may mechanically expel the combined material 116 using rollers, conveyors, pulleys, and other mechanisms. The expelling component may also/alternatively use, for example, air and/or water to expel the combined material 116 from the intermittent splicer 114. Further, it is contemplated that the combined material may be expelled from the intermittent splicer 114 by gravity and/or a pushing force exerted by an added material portion.

As can be seen from FIG. 1, the combined material 116 may comprise variable-length segments composed of material A 110 and material B 112. For instance, the combined material 116 may comprise a variable-length segment 116A composed of material A 110, a variable-length segment 116B composed of material B 112, and a variable-length segment 116C again composed of material A 110. Other arrangements are contemplated such as a B-A-B arrangement, an A-B-A-B arrangement, a B-A-B-A arrangement, and so on. When more than two materials are used, the composition of the combined segment 116 may be adjusted accordingly. By way of illustrative example, if materials A, B, and C are used, one possible composition may comprise A-C-B-A. As can be seen, a near-infinite number of possibilities exist based on the number of materials used, the possible arrangement of materials, and the lengths of each portion of material used.

It is contemplated that the intermittent splicer 114 may be used in conjunction with any mechanism, such as a loom. Further, it is contemplated that the intermittent splicer 114 may be used independently of other mechanisms. The intermittent splicer 114 may also be implemented during any portion of a manufacturing process (e.g., forming the warp, passing the weft).

In an exemplary aspect, once expelled from the intermittent splicer 114, the combined material 116 is received by the feeding component 118 via, for example, an input port. The feeding component 118 may passively receive the combined material 116 from the expelling component. The feeding component 118 may also actively retrieve the combined material 116 from the intermittent splicer 114. For instance, the feeding component 118 may generate a vacuum that draws the combined material 116 into the feeding component 118.

The feeding component 118 is also configured to subsequently feed the combined material 116 into the loom 122. The combined material 116 may be fed in to the loom 122 as a weft. However, as previously discussed, the combined material may be used in connection with forming a warp beam. If the combined material 116 is fed in as a weft, the feeding component 118 may comprise a shuttle, one or more rapiers, an air jet, a water jet, and the like.

The feeding component 118 may be associated with the dynamic tensioner 120. The dynamic tensioner 120 is configured to apply a variable amount of tension to the combined material 116 as it is being fed into the loom 122 by the feeding component 118. The amount of tension applied may depend on the properties of the combined material 116 as it is passing through the dynamic tensioner 120. For instance, a smaller degree of tension may be applied to a more elastic segment of the combined material 116 as compared to the amount of tension applied to a less elastic segment of the combined material 116. Applying variable amounts of tension depending on the properties of the combined material 116 helps to ensure that the combined material 116 is fed smoothly into the loom 122. Further, it is contemplated that the dynamic tensioner 120 dynamically adjusts tension based, at least in part, on the characteristics of the combined material 116 that has already passed through the dynamic tensioner 120 for a particular weft pass. For example, if a non-elastic portion of material initially passes through the dynamic tensioner 120, a greater amount of tension may be applied than when an elastic portion or even a subsequent non-elastic portion passes through the dynamic tensioner 120 on a common weft pass.

The dynamic tensioner 120 may apply tension by, for example, adjusting the diameter of the input port of the feeding component 118. In instances where the feeding component 118 is an air jet, tension may be adjusted by varying the amount of air used to propel the combined material 116 into the loom 122. Likewise, if the feeding component 118 is a water jet, tension may be adjusted by varying the force of the water used to propel the combined material into the loom 122. Further, it is contemplated that the dynamic tensioner 120 may be formed from one or more compressive surfaces that apply varied levels of compressive forces on the combined material (e.g., rotating (or not) mated discs in a pulley-like orientation that have graduated mated surfaces that may be separated or closed to impart a desired level of compressive force to a multiple material passing through the graduated mated surfaces).

The dynamic tensioner 120 may use a caliper-based system to determine when tension should be adjusted and how much the tension should be adjusted. For example, the caliper system may detect a thicker segment of the combined material 116 and increase the tension applied to the combined material 116. The dynamic tensioner 120 may also use a vision/optical system to visually detect a transition from one segment of the combined material 116 to an adjacent segment of the combined material 116. The vision/optical system may also detect properties of the segment that determine how much tension should be applied; the tension may then be adjusted accordingly. For instance, the vision/optical system may be configured to detect a color or texture change from one segment to the next of the combined material 116. Based on this change, the dynamic tensioner 120 may adjust the tension on the combined material 116. The dynamic tensioner 120 may also use a timing system to determine when tension should be adjusted. For example, the combined material 116 may be expelled from the intermittent splicer 114 at a constant rate. The dynamic tensioner 120 may adjust the tension depending on the rate of expulsion. The dynamic tensioner 120 may also receive inputs from, for example, the logic unit 124, and adjust the tension based on the received inputs. As a result, it is contemplated that one or more mechanisms may be implemented independently or in concert to adjust the dynamic tensioner 120 to impart one or more desired characteristics to a resulting product at one or more desired locations.

In one aspect, the dynamic tensioner 120 may be utilized as a quality control measure. For instance, the dynamic tensioner 120 may apply an additional amount of tension to the combined material 116 to adjust the combined material 116 after it has been fed as a weft through a shed. This may be used to correct minor deviations in alignment of the weft with respect to the pattern that is being woven. For example, if a combined material has a particular portion intended to be placed at a particular location (e.g., at a particular location laterally along the warps), the dynamic tensioner 120 may impart an elevated level of tension to allow the combined material to slightly extend a length at which it crosses a portion of the warp. Similarly, it is contemplated that the dynamic tensioner 120 may impart a decreased level of tension to allow the combined material to slightly reduce a length affecting a location as portion crosses a particular warp. Additional mechanisms for adjusting a location of the combined material are contemplated that may not affect the stretch of the combined material (e.g., incorporating an excess portion at either (or both) ends of a weft pass to allow for lateral alignment by the feeding component 118.

Although the dynamic tensioner 120 is shown in FIG. 1 as being integrally attached to the feeding component 118, other arrangements are contemplated. For instance, the dynamic tensioner 120 may be physically separate from the feeding component 118. The dynamic tensioner 120 may be located between the intermittent splicer 114 and the feeding component 118. Alternatively, the dynamic tensioner 120 may be located between the feeding component 128 and the loom 122. Further, as previously discussed, it is contemplated that one or more components may be omitted entirely or in part, in an exemplary aspect.

As mentioned, the feeding component 118 feeds the combined material 116 into the loom 122 as either a warp or a weft. The loom 122 may comprise any type of weaving structure. For example, the loom 122 may comprise a single or multiple-beam loom, a Jacquard loom, a Dobby loom, and other looms known in the art.

The logic unit 124 may be programmably-coupled to the intermittent splicer 114, the feeding component 118, the dynamic tensioner 120, and/or the loom 122 through a wireless or wired connection. The logic unit may be comprised of a processor and memory to perform one or more of the functions provided herein. Computer-readable media having instructions embodied thereon for performing one or more functions may be implemented with the logic unit 124 to effectuate one or more of the functions. The logic unit 124 may instruct these various components based on, for example, a pattern program to produce a woven product conforming to the pattern.

Figure 6:
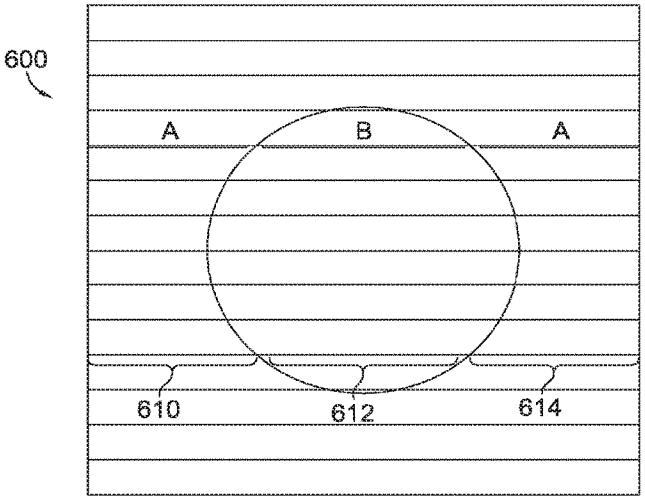
FIG. 6 depicts an exemplary pattern program used by a logic unit in an aspect of the present invention.

FIG. 6 depicts an exemplary pattern program 600 that may be captured (e.g., by a camera) and processed by the logic unit 124 to calculate what segment lengths of material A 110 and/or material B 112 are needed at each weft (and/or warp) level. The pattern program 600 comprises a series of lines corresponding to wefts with a pattern superimposed on the lines. The lengths of various segments of the pattern program 600 may be determined by the logic unit 124 and subsequently communicated to, for example, the intermittent splicer 124. For example, the logic unit 124 may determine a length/distance of segment 610 (corresponding to material A 110), segment 612 (corresponding to material B 112), and segment 614 (corresponding to material A 110). The various lengths/distances of these segments 610, 612, and 614 may be communicated by the logic unit 124 to the intermittent splicer 114; the intermittent splicer 114 then terminates and combines materials based on these inputs.

Further, the logic unit 124 may also be programmably-coupled to the various vision/optical, timing, toggle wheel, and caliper-based systems associated with these components. The logic unit 124 may, in one aspect, receive inputs from the various vision/optical, timing, toggle wheel, and caliper-based systems, and, based on these inputs and a programmed pattern/structure, instruct the intermittent splicer 114 to terminate the material A 110 or the material B 112 at a predetermined location. Further, the logic unit 124 may instruct the dynamic tensioner 120 to apply a predetermined amount of tension to the combined material 116 based on received inputs. Any and all such aspects are within the scope of the invention.

As provided herein, it is contemplated that the logic unit 124 may be comprised of a computing device. Therefore, the logic unit 124 may maintain one or more set of instructions useable by one or more components (e.g., intermittent splicer, loom, dynamic tensioner, Jacquard loom, measurement components, quality control components) to manufacture an article. The instructions may include logic capable of coordinating the automatic terminating and splicing of materials such that when inserted through a shed may be positioned in a defined location relative to the warp beam. Further, the logic may ensure the proper alignment and positioning of one or more portions of a multiple material element as integrated into an article.

The logic unit 124 may store the instructions or may receive the instructions. For example, it is contemplated that the logic unit 124 may be connected via a network to one or more computing devices that maintain parameters to complete a particular article. Upon receiving an indication to manufacture a particular article, the proper instructions (or portions thereof) are communicated to the logic unit 124 for controlling one or more components to effectuate the manufacturing of the article. As such, it is contemplated that the logic unit 124 may be responsible for ensuring that typically disparate components may operate in concert to automatically produce an article through the coordination of one or more functions of each of the components.

Figure 2:
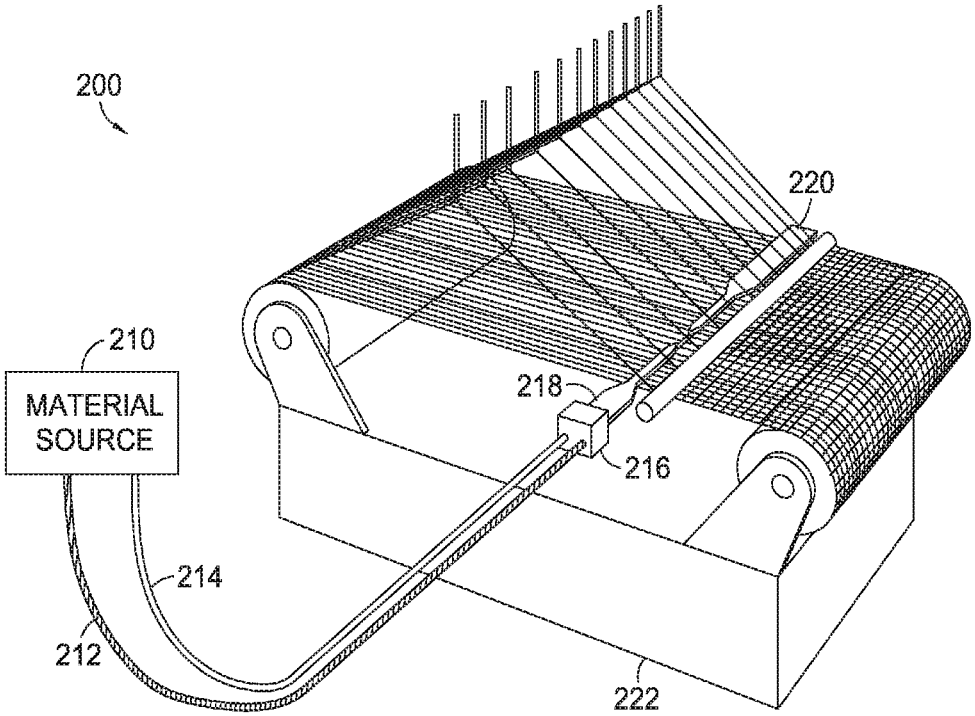
FIG. 2 depicts an exemplary intermittent weaving splicer m association with a feeding component in an aspect of the present invention.

Turning now to FIG. 2, another aspect of the invention is illustrated. FIG. 2 depicts a system 200 comprising a material source 210, a material 212, a material 214, an intermittent splicer 216 that is integrally connected to a feeding component 218, and a receiving component 220. The feeding component 218 and the receiving component 220 may comprise a first rapier and a second rapier. Traditional weaving technology employs rapiers to feed wefts across a shed. A first rapier feeding a weft is met by a second rapier at a point across the width of the weave. The second rapier takes the weft and completes the journey of the weft across the width of the weave (e.g., the length of the warp beam).

The feeding component 218 may be dynamically programmed (by, for example, a logic unit) to deliver the weft to the receiving component 220 at varying distances along the width of the weave instead of at the midway point of the weave. Further, the intermittent splicer 216 may be programmed to terminate material 212 and/or material 214 and generate a combined material prior to the feeding component 218 meeting the receiving component 220 and transferring the combined material.

Figure 3:
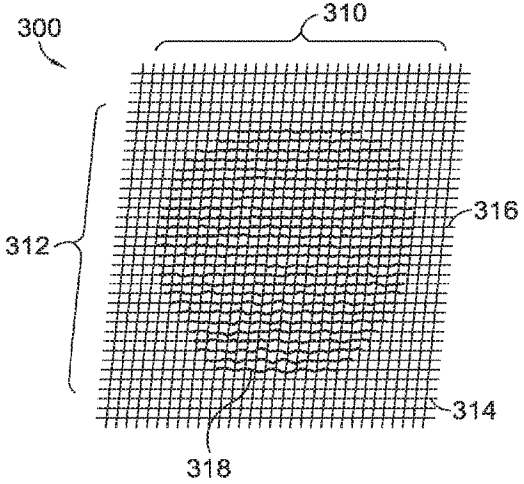
FIG. 3 depicts an exemplary portion of a woven product in an aspect of the present invention.

FIG. 3 depicts a close-up view of an exemplary woven product 300 that may be produced by the system 100. The woven product 300 comprises a series of warp threads 310. Although the term "thread" is used for convenience sake, it is contemplated that the term "thread" may comprise any type of material discussed previously, including fabric materials, plastic materials, synthetic materials, metal materials, and the like. The woven product 300 also comprises a series of weft threads 312. In this example, a portion of the weft threads 312 comprises combined material weft threads generated by, for example, an intermittent splicer such as the intermittent splicer 114 of FIG. 1. Thread 314 provides an example of a weft thread that is comprised of one material, while thread 316 illustrates a weft thread comprised of more than one material.

The weft threads 312 are woven to produce an area 318. The area 318 may have different functional properties as compared to the remainder of the woven product 300. For instance, the area 318 may have a greater amount of stretch as compared to the remainder of the woven product 300. In another example, the area 318 may be composed of thermoreactive, and/or chemical reactive materials (e.g., water soluble). These materials may be treated with an appropriate agent (heat, water, and/or chemical) to eliminate the area 318 or to further change the functional properties of the area 318.

Additionally, the area 318 may have different aesthetic properties as compared to the remainder of the woven product 300. For instance, the area 318 may be a different color than the remainder of the woven product 300, or be composed of weft threads having a matte or shiny finish. The area 318 may comprise a logo, graphic elements, geometric-shaped patterns, or organically-shaped patterns. Further, the area 318 may be woven from weft threads having a different diameter as compared to the remainder of the woven product 300. This may help to impart a three-dimensional aspect to the area 318. Any and all such variations are within the scope of the invention.

Figure 5:
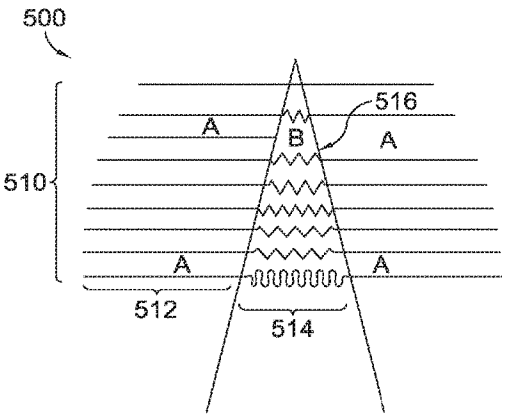
FIG. 5 depicts an exemplary portion of a woven product in an aspect of the present invention.

FIG. 5 depicts another exemplary portion of a product 500 that may be produced by the system 100. The focus of FIG. 5 is on the combined material that makes up the weft threads 510. Because of this, the warp threads are not depicted. The combined material that makes up the weft threads 510 comprises a first segment 512 of a first material (material A), a second segment 514 of a second material (material B), and a third segment 516 of the first material (material A). The second material in the second segment 514 may comprise crimped yarn. An example of crimped yarn is a polyester fill, such as used for insulation in jackets or as stuffing in pillows. This type of yarn is generally resistant to stretching which gives it loft and volume. Other materials may be used. Fr[sic] example, an organic material that is crimped (e.g., cotton that has been crimped and maintained with a starch-like additive). However, crimped yarn typically stretches as heat is applied, particularly when under tension; the heat causing the crimped yarn to lose its crimp. Taking advantage of these properties of crimped yarn, heat may be selectively applied as a post process or after assembly to the portion of the product 500 containing the crimped yarn (i.e., area 518). The application of heat and/or tension may cause the area 518 to elongate or stretch which adds three-dimensionality to the product 500. One example where this type of process is useful is in the creation of a heel portion of a shoe upper.

Figure 4:
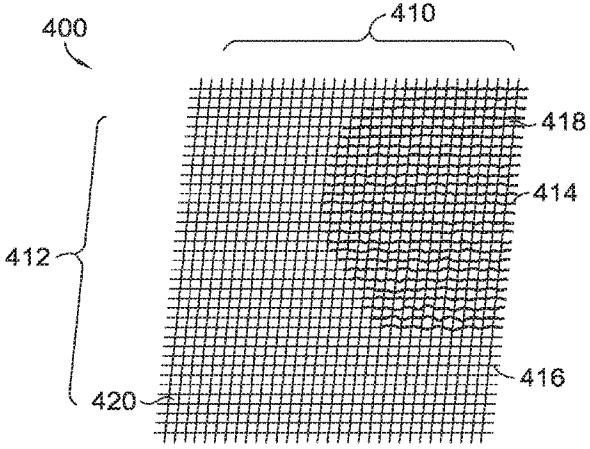
FIG. 4 depicts an exemplary portion of a woven product in an aspect of the present invention.

FIG. 4 depicts an exemplary portion of a woven product 400 that may be produced by the system 200. The woven product comprises a set of warp threads 410 and a set of weft threads 412. Like above, the term "thread" is meant to encompass any number of materials. A portion of the weft threads 412 comprises weft threads of combined materials generated by an intermittent splicer such as the intermittent splicer 216 of FIG. 2. Weft thread 414 is an example of a weft thread of combined materials. Additionally, a portion of the weft threads 412 comprises weft threads composed of one type of material (for example, weft thread 416).

As described above, the system 200 comprises a feeding component (in this case, a first rapier) that may be dynamically adjusted to deliver weft threads different distances along the width of the weave. A corresponding receiving component (a second rapier) may also be dynamically adjusted to receive the weft thread at the point of handoff from the feeding component. An intermittent splicer may generate a weft of combined materials prior to the receiving component receiving the weft thread from the feeding component. The result is the ability to produce a variety of geometric or organically-shaped patterns having different functional and/or aesthetic properties. For instance, area 418 of the woven product 400 is composed of weft threads having different properties from the weft threads that make up the area 420. Like above with respect to FIGS. 3 and 5, the weft threads in the areas 418 and 420 may have different functional properties and/or different aesthetic properties.

As depicted, it is contemplated that any combination of combined materials may be implemented at any location to form a product having organic-shaped characteristic portions imparted by selectively changing underlying materials of a weft. For example, the characteristic portions may have varied aesthetic and/or functional characteristics at specified locations. The ability to selectively impart desired characteristics intermittently in a weft pass (as opposed to having a uniform characteristic along a complete weft pass) provides increased control of a weaving process.

Figure 7:
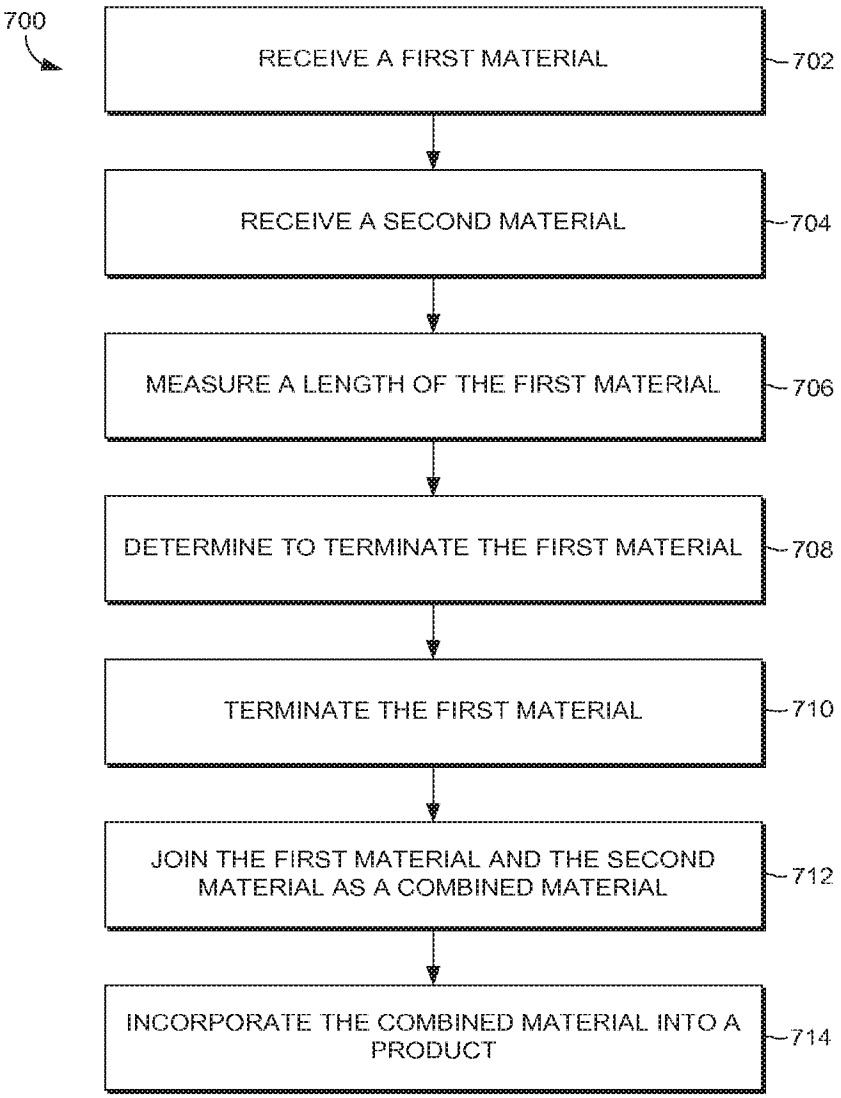
FIG. 7 depicts an exemplary flow diagram illustrating a method of creating a combined material from a first material input and a second material input in an aspect of the present invention.

FIG. 7 depicts a block diagram illustrating an exemplary method 700 for utilizing an intermittent splicer, in accordance with aspects of the present invention. At a block 702, a first material is received at the intermittent splicer. As previously discussed, the material may be any material, such as a yarn, thread, webbing, and the like. Receiving of a material may include a portion of the material entering one or more portions of the intermittent splicer. At a block 704, a second material is received at the intermittent splicer. As previously discussed, any number of materials may be received/utilized at/by an intermittent splicer.

At a block 706 a length of the first material is measured. The length may be measured to result in a particular length of the first material at a particular location within a resulting combined material. The measuring may be accomplished using mechanical mechanisms, timing mechanisms, optical mechanisms, and other techniques for measuring a length of a material. At a block 708, a determination is made to terminate the first. The determination may be accomplished utilizing a logic unit that controls a terminator of the intermittent splicer. The determination may be made, at least in part, based on the measured length of the first material and a desired length to be used in a resulting combined material. Further, the logic unit may rely on a programmed pattern that coordinates the intermittent splicer and one or more manufacturing machines (e.g., loom, knitting machine, braider), which may be used in conjunction with the intermittent splicer. Once a determination to terminate is made at the block 708, at a block 710 the first material is terminated. The termination may be effected by a mechanical cutting, a chemical process, a heating process, an ultrasonic process, and/or the like.

At a block 712, the first material and the second material are joined. The joining of the first and second materials may rely on a mechanical connection among elements (e.g., fibers) of each of the materials. Additionally, it is contemplated that other bonding techniques may be used to join the first material and the second material (e.g., welding, adhesive). Once the first material and the second material are joined, the resulting combined material may be incorporated into a product. For example, the resulting product may be formed using a number of machines and techniques, such as a loom for a woven article, a knitting machine for a knit article, a braiding machine for a braided article, and the like.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A weaving system comprising:

a loom;

an intermittent weaving splicing device that terminates and combines material inputs to produce a combined material output;

a dynamic tensioner that applies variable amounts of tension to the combined material output while the combined material output is being woven wherein the variable amounts of tension depend on a property of the combined material output;

and a logic unit that interacts with the loom, the dynamic tensioner, and the intermittent weaving splicing device.

2. The weaving system of claim 1, wherein the combined material output further comprises a plurality of individual segments.

3. The weaving system of claim 2, wherein the variable amounts of tension are applied based on characteristics of the plurality of individual segments of the combined material output.

4. The weaving system of claim 2, wherein the plurality of individual segments further comprises an elastic portion and a non-elastic portion.

5. The weaving system of claim 4, wherein the dynamic tensioner applies a greater amount of tension to the elastic portion of the combined material output, and wherein the dynamic tensioner applies a lesser amount of tension to the non-elastic portion of the combined material output.

6. The weaving system of claim 1, further comprising:

a feeding component, wherein the feeding component feeds the combined material output into the loom.

7. The weaving system of claim 6, wherein the feeding component feeds the combined material output into the loom as at least one of a warp thread or a weft thread.

8. The weaving system of claim 7, wherein the dynamic tensioner applies tension to the combined material before the combined material is inserted into the loom.

9. A weaving system comprising:

a loom;

an intermittent weaving splicing device that terminates and combines material inputs to produce a combined material output;

a feeding component;

a dynamic tensioner having an input port and an output port, wherein the dynamic tensioner applies variable amounts of tension to the combined material while the combined material is being woven, and wherein the variable amounts of tension depend on a property of the combined material output;

a logic unit that interacts with the loom, the dynamic tensioner, and the intermittent weaving splicing device; and an expelling component that expels the combined material output from the intermittent weaving splicing device.

10. The weaving system of claim 9, wherein the dynamic tensioner applies tension to the combined material output by adjusting a diameter of the input port of the dynamic tensioner.

11. The weaving system of claim 9, wherein the feeding component is an air jet.

12. The weaving system of claim 11, wherein an amount of tension applied by the dynamic tensioner is adjusted by varying an amount of air pressure applied by the air jet.

13. The weaving system of claim 9, wherein the feeding component is a water jet.

14. The weaving system of claim 13, wherein an amount of tension applied by the dynamic tensioner is adjusted by varying an amount of water pressure applied by the water jet.

15. The weaving system of claim 9, wherein the dynamic tensioner further comprises one or more compressive surfaces that apply varied levels of compressive forces to the combined material output.

16. The weaving system of claim 9, wherein the dynamic tensioner comprises rotating mated discs in a pulley-like orientation.

17. A weaving system comprising:

a loom;

an intermittent weaving splicing device that terminates and combines material inputs to produce a combined material output; and a dynamic tensioner that applies variable amounts of tension to the combined material output while the combined material output is being woven wherein the variable amounts of tension depend on a property of the combined material output.

18. The weaving system of claim 17, further comprising:

an optical system configured to detect a color or texture change in the combined material output.

19. The weaving system of claim 18, wherein the dynamic tensioner varies the variable amounts of tension being applied to the combined material output based on the detected color or texture change.

20. The weaving system of claim 17, further comprising:

a timing system to determine when the dynamic tensioner should change the variable amounts of tension being applied to the combined material output.

* * * * *